US005678309A

United States Patent [19]

Richter

[11] Patent Number: 5,678,309

[45] Date of Patent: Oct. 21, 1997

[54] PROCESS FOR PREPARING A LEAF-SHAPED OSCILLATORY SPRING FOR ELECTRIC DIAPHRAGM PUMPS

[76] Inventor: Siegfried Richter, Himmelreich 9, 88605 Sauldorf-Rast, Germany

[21] Appl. No.: 554,873

[22] Filed: Nov. 7, 1995

[30] Foreign Application Priority Data

Nov. 8, 1994 [DE] Germany ..... 44 39 823.9

[51] Int. Cl.[6] ..... B23P 13/00

[52] U.S. Cl. ..... 29/896.9

[58] Field of Search ..... 29/896.9; 72/342.1, 72/342.94; 83/50, 55

[56] References Cited

U.S. PATENT DOCUMENTS 5,046,227 9/1991 Akiike et al. ..... 29/896.9

FOREIGN PATENT DOCUMENTS 39 21 084 C2 1/1991 Germany .

*Primary Examiner*—P. W. Echols

*Attorney, Agent, or Firm*—McGlew and Tuttle

[57] ABSTRACT

The process is used to prepare a leaf-shaped oscillatory spring of a rectangular or square surface shape, made of hardenable spring steel for electric diaphragm pumps, which have as the drive motor an oscillating armature magnet, with is provided with an axially oscillating plunger-type armature arranged coaxially to a system axis in the interior space of a central magnet coil. The oscillatory spring has two spring legs, which are connected by a head-side cross web and are each provided in the free foot area with a fastening hole used for the positioning accommodation of a cylindrical centering pin each, and the oscillatory spring has, approximately in the center of its surface, a flexible tongue cut free on three sides, with a central fastening bore for a plunger-type armature shaft. To make possible a high dimensional accuracy and exact, stress-free fastening of the oscillatory springs in an economical manner, the oscillatory spring is punched in its surface shape with at least one fastening bore from a soft strip material and then hardened. The remaining fastening holes are subsequently punched in a second punching process in the hardened state of the oscillatory spring.

3 Claims, 1 Drawing Sheet

PROCESS FOR PREPARING A LEAF-SHAPED OSCILLATORY SPRING FOR ELECTRIC DIAPHRAGM PUMPS

FIELD OF THE INVENTION

The present invention pertains to a process for preparing a leaf-shaped oscillatory spring of a rectangular or square surface shape made of hardenable spring steel for electric diaphragm pumps with an oscillating armature magnet as the drive motor, which has an axially oscillating plunger-type armature in the interior space of a central magnet coil coaxially to a system axis, wherein the oscillatory spring has two spring legs connected by a head-side cross web with one fastening hole each in the respective free foot area, and a flexible tongue cut free on three sides in the center of its surface, with a central fastening bore for one plunger-type armature shaft.

BACKGROUND OF THE INVENTION

Such diaphragm pumps, which have been known from, e.g., DE-39 21 084 A1, are used both as pressure pumps and as vacuum pumps; as compressors, e.g., in connection with inhalation devices for finely atomizing liquid drugs, or as vacuum pumps in chemical or physical laboratories.

To achieve a high efficiency during operation at the lowest possible noise level and long life, accurate guiding of the oscillating armature, on the one hand, and stress-free mounting or fastening of the oscillatory springs supporting the oscillating armature, on the other hand, are important. To achieve accurate guiding of the oscillating armature, it is necessary for the fastening bores or holes of the oscillatory springs to be positioned accurately in relation to one another. It is important for the stress-free fastening of the oscillatory springs on a housing accommodating the oscillating armature magnet that the fastening holes, with which the spring legs are positioned on contact surfaces of the housing, be able to accommodate the centering pins provided in the contact surfaces in a stress-free manner, with the smallest possible clearance tolerances.

To satisfy these conditions, the oscillatory spring with its fastening bores or holes was punched in one operation after hardening, i.e., in the hardened state of the starting material. It was necessary in this case to accept the fact that the punching dies needed for this purpose were had the ability to be used only for a small number of pieces because of the considerable stress on the material. The alternative to this, which was sometimes practiced, consisted of carrying out the punching of the oscillatory springs with their fastening bores or holes in the still soft state of the material, and of hardening the completely punched oscillatory springs thereafter. However, a reject rate of about 30% must be expected in this case, which is due to deformations of the oscillatory springs during the hardening process. These deformations become noticeable especially in changes in the distances between the fastening holes, so that they no longer fit the centering pins. Attempts were also made to reduce this reject rate by the foot ends of the two spring legs remaining connected by a connecting web. Even though the distances between the holes can thus be extensively prevented from changing, material stresses are generated in the oscillatory spring, and they not only greatly reduce the life of such an oscillatory spring, but they also lead to malfunctions in the oscillating behavior and to loud noises during operation.

SUMMARY AND OBJECTS OF THE INVENTION

The primary object of the present invention is to provide a process of the type described in the introduction, by which better quality can be achieved in terms of the dimensional accuracy of the fastening and guiding elements and consequently an accurate and stress-free fastening of the oscillatory springs at a high level of economic efficiency.

This object is accomplished according to the present invention in that the oscillatory spring in its surface shape with at least one fastening bore is punched from a soft strip material in a first punching process and then hardened, and that the remaining fastening hole/the remaining fastening holes is/are subsequently punched in the hardened state of the oscillatory spring in a second punching operation.

It is also possible, in principle, to prepare all fastening bores or holes in the second punching operation. However, it is more advantageous to already prepare at least the fastening bore of the flexible tongue in the first punching process because it is thus possible to use this fastening bore as a reference point in the second punching die.

Due to the design of the oscillatory springs wherein one of the fastening holes located in a foot area of the spring leg is round and the other is designed as an elongated hole, whose longitudinal extension extends in parallel to a cross-web connecting the spring legs, it is also possible to punch the springs with all fastening bores or holes in the soft state of the material and to subsequently harden them. However, the safety of low-noise operation and higher accuracy concerning the guiding of the plunger-type armature are also achieved in this embodiment of the oscillatory spring if it is prepared by the process according to the present invention.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

The significance of the accurate guiding of the plunger-type armature in a diaphragm suction pump, in which the oscillating armature, which oscillates axially, is fastened in a guided and supported manner on oscillatory springs of this type, will be explained on the basis of FIG. 3.

Figure 3:
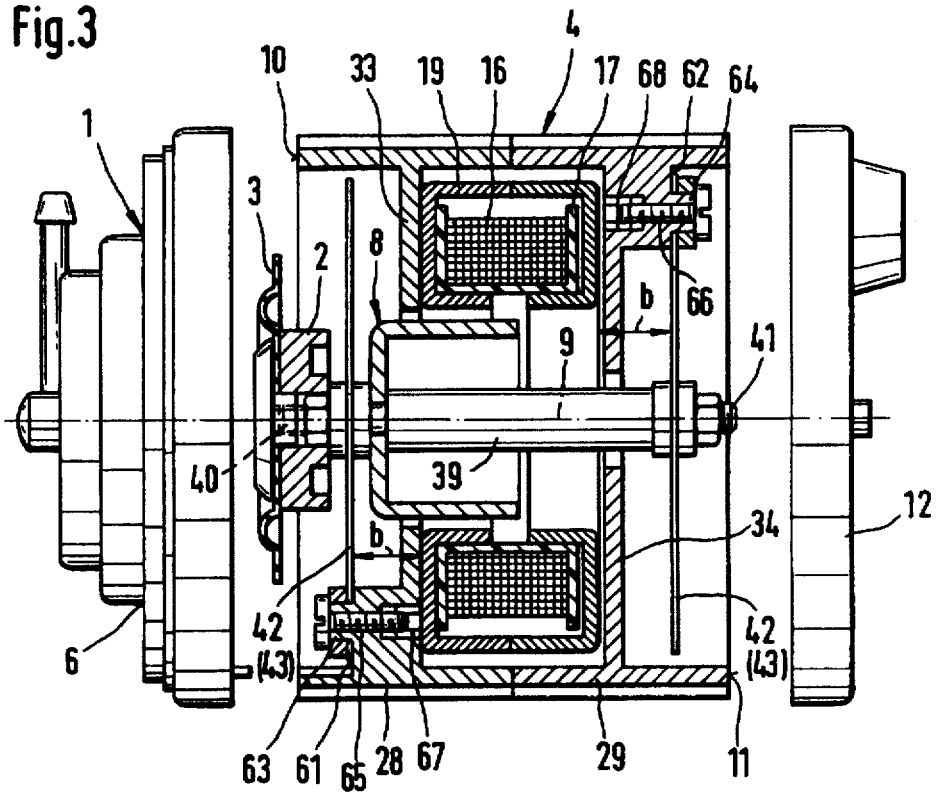
FIG. 3 is a sectional view of an electric diaphragm suction pump with an oscillating armature supported by two oscillatory springs.

The diaphragm suction pump shown in FIG. 3 comprises a suction pump unit 1 with a pump diaphragm 3 fastened on a central diaphragm holder 2 as well as an oscillating armature magnet 4.

The pump diaphragm 3 is fastened to an oscillating armature 8 of the oscillating armature magnet 4 in the usual manner with a piston-like diaphragm holder 2, disposed coaxially with respect to the system axis 9 of the oscillating armature 8.

The pump housing 6 shown in FIG. 3 at an axially spaced location from the oscillating armature magnet 4 is in its operative position placed on the front side 10 of the oscillating armature magnet 4 and is fastened thereon by screw connections. A cover 12, which is likewise screwed on, is arranged on the opposite front side 11 of the oscillating armature magnet 4.

The valves needed for generating a pumping process are also accommodated in the pump housing 6. The oscillating armature magnet 4 has a round magnet coil 16, arranged concentrically to the system axis 9, with a coil former 17, which has a U-shaped profile and is surrounded by a ferromagnetic short-circuit cage 19.

The short-circuit cage 19 is accommodated centered in each half of the two housing halves 28 and 29, which have a completely identical design and are screw-connected to one another.

The oscillating armature 8 is composed of a ferromagnetic, pot-shaped plunger-type armature 38 and a nonmagnetic armature shaft 39, which axially projects from the short-circuit cage 19 on both sides and has threaded projections 40 and 41 of reduced diameter at both of its ends.

Figure 1:
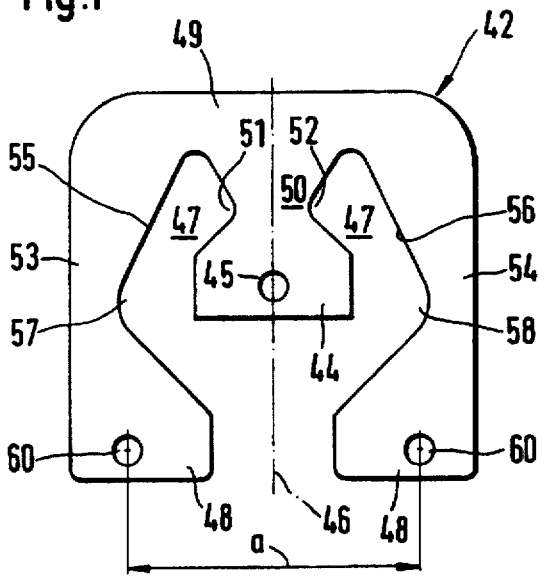
FIG. 1 is a top view of an oscillatory spring prepared by the process according to the present invention.
Figure 2:
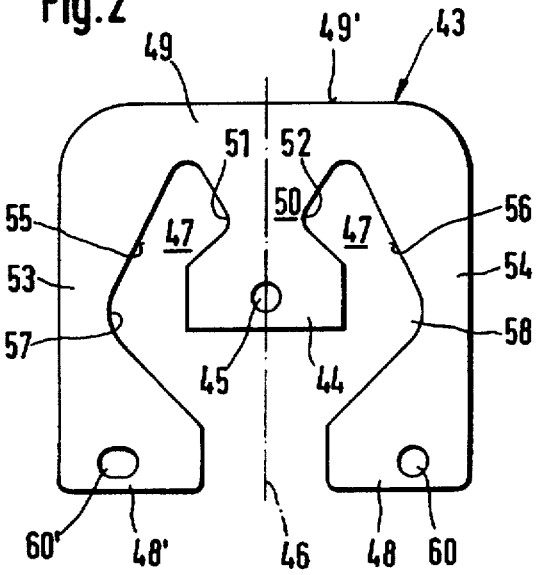
FIG. 2 is a top view of another embodiment of the oscillatory spring.

The armature shaft 39 is fastened by means of these threaded projections 40 and 41 to two leaf-shaped oscillatory springs 42 or 43. These oscillatory springs 42, 43 have either the shape according to FIG. 1 or the shape according to FIG. 2, both of which are characterized by a rectangular or square surface shape and are provided in the center of their surfaces with a flexible tongue 44, which has a central fastening bore 45 for the fitting, i.e., possibly clearance-free accommodation of the two threaded projections 40 or 41. This flexible tongue 44 is cut free by a cutout 47 shaped symmetrically to the axis of symmetry 46 on the underside as well as on its sides extending in parallel to the axis of symmetry 46. The flexible tongue 44 is provided on both sides with triangular incisions 51, 52 symmetrical to the axis of symmetry 46 on its section 50, which directly joins the top-side cross web 49 connected to it. The two lateral spring legs 53, 54, which are connected to one another by the upper cross web 49, also have inner limiting edges 55 and 56, which are formed by respective incisions 57 and 58 having the shape of isosceles triangles. The two oscillatory springs 42 and 43 according to FIGS. 1 and 2 differ only in that the two spring legs 53 and 54 of the oscillatory spring 42 have round fastening holes, i.e., fastening bores 60, in their foot sections 48, while the foot section 48' in the embodiment according to FIG. 2 is provided with an elongated hole 60', whose longitudinal extension parallels the upper cross web 49 or to its top edge 49'.

To fasten the two oscillatory springs 42 and 43 fiat contact surfaces 61 and 62 with continuous centering pins 63 and 64 and with continuous plug holes 65 and 66, which contact surfaces extend radially and at right angles to the system axis 9, are arranged on the outsides of radial walls 33 and 34 at a certain axial distance b from the short-circuit body 19. The plug holes 65, 66 open into respective expanded hexagonal holes 67 and 68. The centering pins 63 and 64 are used for accommodating the fastening holes 60 and 60' of the two spring legs 53, 54 in a centering or aligning manner.

It is important in this connection for the oscillating armature 8 with its plunger-type armature shaft 39 and thus also with its plunger-type armature 38 to be guided exactly coaxially to the system axis 9 and for the two oscillatory springs 42 and 43 to be able to operate without internal stresses in the material.

However, this can be achieved only if the fastening bore 45 of the flexible tongue 44 is positioned accurately on the axis of symmetry 46 in relation to at least one of the two fastening holes 60 in one of the spring legs 53, 54, and the two fastening holes must be arranged at a certain distance a, symmetrically to the axis of symmetry 46, especially if both are round. These are the conditions under which the two spring legs 53, 54 can be accommodated by the respective centering pins 63, 64 associated with them in a stress-free manner, so that the plunger-type armature shaft 39 assumes an exactly coaxial position in relation to the system axis 9 at least in its resting position. To achieve this goal in the most economical manner possible, the oscillatory springs 42, 43 are first punched according to the present invention in the soft, i.e., non-hardened state of the material, with at least the fastening bore 45 of the flexible tongue 44, and they are hardened only thereafter. After hardening, which may lead to deformations and distortions in the material of the oscillatory spring, the remaining fastening hole or fastening holes 60, 60' is/are then punched in the hardened state of the material in a second punching operation. It is obvious that the punching die used for this purpose must be adjusted such that the predetermined positions of the fastening holes 60, 60' can be exactly obtained, for which purpose especially suitable positioning aids for exactly inserting the oscillatory springs 42, 43 belong in the die.

In the oscillatory spring 43 provided with an elongated hole 60', a substantial reduction in the reject rate can be achieved even by preparing the fastening bore 45 as well as the other fastening holes 60 and 60' prior to hardening, i.e., in the soft state of the material, in the first and consequently only punching process, because the elongated hole 60' can accommodate the corresponding centering pin of the housing in a stress-free manner even if the distance a has changed due to the hardening. Precisely the change in this distance a between the two round fastening holes 60 in the spring legs 53, 54 is the most frequent cause for the unsuitability of deformed oscillatory springs.

While specific embodiments of the invention have been shown and described in detail to illustrate the application of the principles of the invention, it will be understood that the invention may be embodied otherwise without departing from such principles.

What is claimed is:

1. A process for preparing a leaf-shaped oscillatory spring of rectangular or square surface shape from a hardenable spring steel, for electric diaphragm pumps with an oscillating armature magnet as the pump drive, the drive having an axially oscillating plunger-type armature shaft in an interior space of a central magnet coil coaxial with a system axis, wherein the oscillatory spring has two spring legs, connected by a head-side cross web, with fastening holes, each with the positioning accommodation of a cylindrical centering pin, each fastening hole being in the respective free foot area and, approximately in a center of a surface thereof, a flexible tongue cut free on three sides, said flexible tongue having a central bore for said plunger-type armature shaft, the process comprising the steps of:

providing a soft strip material; p1 in a first punching process punching out a surface shape of said oscillatory spring with at least one fastening bore; and subsequently punching the remaining fastening holes when said strip material comprising said oscillatory spring is in a hardened state, in a second punching process.

2. A process according to claim 1, further comprising punching said fastening bore of said flexible tongue during said first punching process.

3. A process for preparing a leaf-shaped oscillatory spring of rectangular or square surface shape, the process comprising the steps of:

providing a hardenable spring steel in the form of a soft strip;

providing an electric diaphragm pump with an oscillating armature magnet as the pump drive, the drive having an axially oscillating plunger-type armature shaft in an interior space of a central magnet coil coaxial with a system axis;

in a first punching process punching the soft strip to punch out a surface shape of said oscillatory spring with at least one fastening bore; and subsequently punching the remaining fastening holes when said strip material comprising said oscillatory spring is in a hardened state, in a second punching process wherein the oscillatory spring has two spring legs, connected by a head-side cross web, with fastening holes, each with the positioning accommodation of a cylindrical centering pin, each fastening hole being in the respective free foot area and, approximately in a center of a surface thereof, a flexible tongue cut free on three sides, said flexible tongue having a central bore for said plunger-type armature shaft.

* * * * *